United States Patent [19]

Worrell, Sr.

[11] 4,131,195

[45] Dec. 26, 1978

[54] DISPOSABLE, COMPACTABLE MOISTURE IMPERVIOUS PACKAGE FOR PREMOISTENED SHEETS

[75] Inventor: Robert A. Worrell, Sr., Chester, Pa.

[73] Assignee: Scott Paper Company, Philadelphia, Pa.

[21] Appl. No.: 859,860

[22] Filed: Dec. 12, 1977

Related U.S. Application Data

[63] Continuation of Ser. No. 719,851, Sep. 2, 1976, abandoned.

[51] Int. Cl.[2] ..... B65D 81/24

[52] U.S. Cl. ..... 206/205; 206/233; 206/484; 206/812; 206/813; 221/63

[58] Field of Search ..... 206/37, 49, 205–210, 206/233, 438, 449, 484, 526, 554, 812; 222/45–49, 63

[56] References Cited

U.S. PATENT DOCUMENTS

| | | | |
|---|---|---|---|
| 2,619,226 | 11/1952 | Adams | 221/63 |
| 3,306,492 | 2/1967 | Kugler | 221/63 |
| 3,784,055 | 12/1972 | Anderson | 206/812 X |
| 3,967,756 | 7/1976 | Barish | 221/63 X |
| 3,979,020 | 9/1976 | Braber et al. | 221/63 |
| 4,002,264 | 1/1977 | Marchesani | 221/63 |

*Primary Examiner*—Steven E. Lipman

*Attorney, Agent, or Firm*—Martin L. Faigus; William J. Foley

[57] ABSTRACT

A disposable, compactable moisture-impervious package for dispensing a stack of premoistened sheets has a pocket portion and a flap portion, each made of a pliable and compactable moisture-impervious material. The pocket portion has first and second walls adhered to each other to provide a compartment between them for receiving the stack of sheets. The sheets are retained in the compartment with their flat surfaces generally parallel to the first and second walls of the pocket. A dispensing opening is provided in one of the walls of the pocket overlying the flat surfaces of the sheets, and a primary seal for the opening prevents the undesirable evaporation of moisture from the sheets. The flap portion of the package extends from a wall of the pocket portion, and is removably securable over the dispensing opening to provide a secondary moisture-impervious seal after the primary seal has been broken.

7 Claims, 5 Drawing Figures

DISPOSABLE, COMPACTABLE MOISTURE IMPERVIOUS PACKAGE FOR PREMOISTENED SHEETS

This is a continuation, of application serial no. 719,851, filed Sept. 2, 1976, now abandoned.

BACKGROUND OF THE INVENTION

Field of the Invention

This invention relates to a moisture-impervious package for storing and dispensing premoistened sheets, and more specifically, to a moisture-impervious package that is compactable.

Description of the Prior Art

Premoistened sheets or wipers have become exceedingly popular for cleaning and/or treating adult and baby skin surfaces; in particular, the hands, face and perineal region. One reason for this popularity is that they can be used in situations where conventional means of cleansing the skin are not readily available. Examples of such situations are: traveling in automobiles, or in other means of transportation not having conventional cleansing facilities; engaging in outdoor sports, such as tennis, fishing, golf and the like; or participating in camping, hiking or picnicking activities. In order for the premoistened sheets to be effectively utilized in the above situations, they must be appropriately packaged so that they can be conveniently transported about without the evaporation or leakage of the moisturizing ingredients.

In the packaging of dry sheets, the escapage of moisturizing ingredients is, obviously, not a problem. Consequentially, dry sheet dispensers generally have not been designed to handle moistened sheets. For that reason, specialty packages have been designed to solve the problems associated with the handling of premoistened sheets.

One of the first commercially acceptable methods of packaging premoistened sheets was to fold each individual sheet into a compact shape, and thereafter seal it within a moisture-impermeable pouch, as disclosed in U.S. Patent No. 3,057,467, issued to Williams. This type of package does retain a premoistened sheet in its wet condition. However, the packaging of individual premoistened sheets in separate moisture-impervious pouches is a relatively expensive packaging technique. Moreover, the dispensing of each premoistened sheet requires the opening, or tearing of its protective pouch. This is a somewhat inconvenient manner of dispensing premoistened tissues, particularly when it is desired to dispense several sheets simultaneously or in a relatively short period of time.

The bulk packaging of premoistened sheets so that they can be easily and reliably dispensed in individual sheet form is known in the prior art. These sheets are generally packaged either in a roll or a stack. Representative roll-type dispensers are disclosed in U.S. Pat. Nos. 3,310,353 and 3,365,522, both issued to Cordis. Representative dispensers employing a stack of sheets are disclosed in U.S. Pat. Nos. 3,499,575, issued to Rockefeller; 3,726,395, issued to Duhy; 3,780,908, issued to Fitzpatrick et al; 3,784,055, issued to Anderson and 3,819,043 issued to Harrison. All of the above packaging systems employ relatively rigid containers or container elements, and many of them are intended to be used over and over again instead of being disposed of when all the sheets originally contained therein have been used. These substantially rigid dispensers are most satisfactorily employed in situations where they are not intended to be conveyed from one place to another, and in which the amount of space they occupy is not particularly important. For example, such dispensers are satisfactory for use in the home and office. However, rigid packaging systems of the type disclosed in the above patents are not easily and conveniently transported between different locations, and therefore, do not provide the most desirable system for use when one is engaged in traveling, or participating in outdoor sports or activities.

The major disadvantages of the above-described rigid dispensers are that they are relatively bulky and are not compactable. That is, they cannot be folded, wadded or bunched into a desired configuration to conserve the amount of space they take up in a pocket, purse, diaper bag, knapsack and the like. In fact, in order to function properly the above-described packaging systems rely, in part, on their containers or container elements maintaining the same shape and dimensions during the entire period of use of the packaging system. Accordingly, even if the containers were made in a smaller size to fit into a pocket or purse, as suggested in Fitzpatrick et al, they would still not be completely satisfactory for many uses because they would still not be compactable. Since they would retain their shape, they would take up the same amount of space when they contained only one premoistened sheet as when they were completely filled.

In a society where people are continually traveling about, and frequently engaging in outdoor sports and other outdoor activities, there is clearly a need for a simple, economical and reliable package for premoistened wipers that can be conveniently held in a pocket, purse, bag, and the like, without occupying excess space. It is to such a packaging system that the instant invention relates.

SUMMARY OF THE INVENTION

This invention relates to a unique disposable package for premoistened sheets or wipers that is simple in design, economical to construct, and easily compactable. Because it is compactable, the package can be folded, wadded or otherwise manipulated so that it will occupy a minimum amount of space as it is being transported about. The package continuously functions to prevent premature evaporation and undesirable leakage of moisturizing ingredients from the sheets, even though the package may be manipulated and folded into many different configurations. Moreover, because of its unique construction and the materials from which it is made, the moisture-impervious package of this invention readily dispenses in individual premoistened sheet, or can be easily manipulated to dispense a group of such sheets.

The disposable, compactable moisture-impervious package of this invention includes a pocket portion and a flap portion, each made of a pliable, moisture-impervious material. The pocket portion has first and second walls adhered to each other to provide a compartment between them for receiving a stack of premoistened sheets. The sheets are retained in the compartment with their flat surfaces generally parallel to the first and second walls of the pocket. A dispensing opening is provided in one of the walls of the pocket overlying the flat surfaces of the sheets, and a primary seal for the opening prevents the undesirable evaporation and/or leakage of moisture from the package before it is initially opened by a user. The flap portion of the package extends from a wall of the pocket portion, and is removably securable over the dispensing opening to provide a secondary moisture-impervious seal after the primary seal has been broken. This secondary seal is effective to prevent the premature evaporation of moisture from the sheets and the undesirable leakage of the moisturizing ingredients from the package.

In the preferred embodiment of the invention, each sheet of the stack of sheets is folded so that it has a dispensing edge. The dispensing opening of the package overlies the dispensing edge of each sheet to permit the edge to be grasped for easy dispensing of the sheets. Also, in the preferred embodiment, the flap and one wall of the pocket portion are formed from the same sheet of pliable, moisture-impervious material. In other words, the flap is a unitary extension of a wall of the pocket portion in the preferred enbodiment.

Other objects and advantages of this invention will become apparent by referring to the detailed description which follows, taken in conjunction with the drawings.

DESCRIPTION OF THE PREFERRED EMBODIMENT

Figure 1:
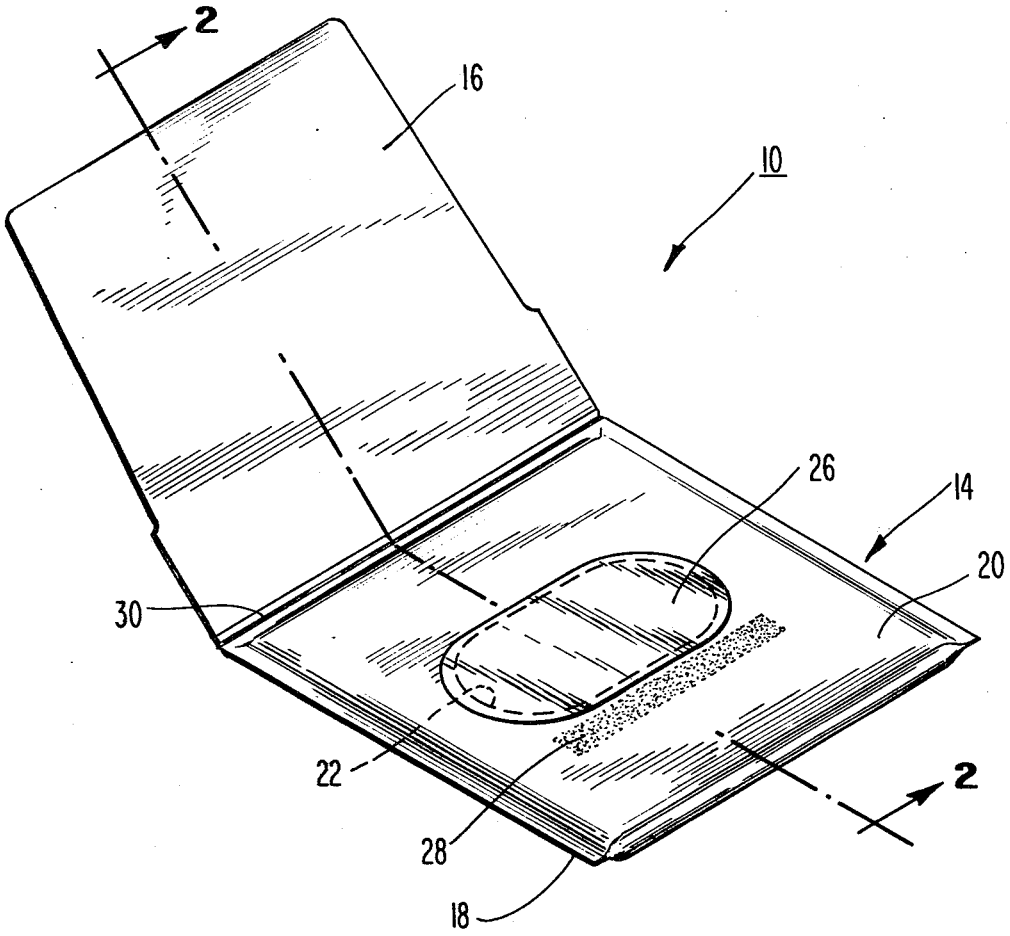
FIG. 1 is an isometric view of a preferred disposable, compactable package of this invention with the flap open.
Figure 2:
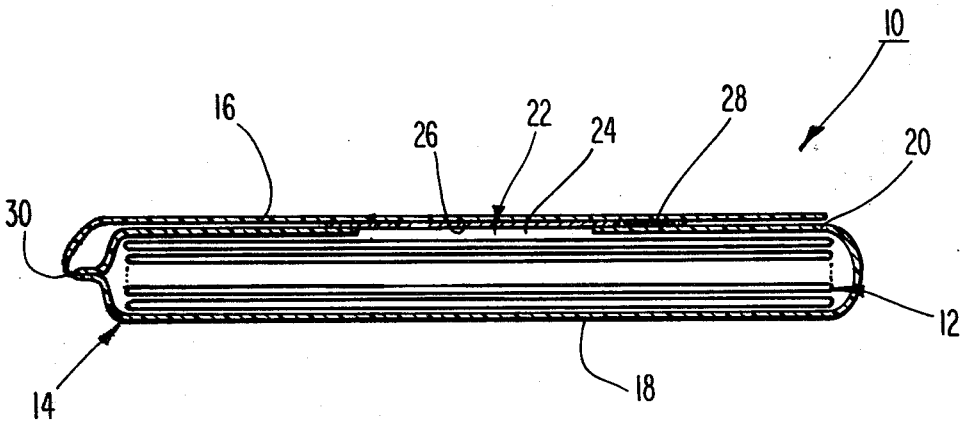
FIG. 2 is a cross-sectional view taken along the line 2-2 of FIG. 1 of the package of this invention with the flap closed.

Referring to FIGS. 1 and 2, a disposable, compactable moisture-impervious package 10 for dispensing a stack of premoistened sheets 12 includes a pocket portion 14 and a flap portion 16. The pocket portion 14 includes first and second walls 18 and 20, respectively, that are adhered together to form a compartment for receiving the stack of sheets 12. A dispensing opening 22 extends through the second wall 20 intermediate its marginal edges, and overlies the flat dimension of the stack of premoistened sheets 12. As can be seen best in FIG. 3 the opening 22 has long and short dimensions substantially perpendicular to each other, and the long dimension is parallel to the hinge line of the flap portion 16. In the embodiment shown for illustration in FIG. 3 the sheets are C-folded to provide two dispensing edges 24 which intersect the opening 22 substantially perpendicular to the long dimension. Either of these edges 24 can be easily gripped with the fingers for dispensing the sheets 12 from the package 10.

A primary seal is provided for the dispensing opening 22 to prevent the escapage of moisture from the package 10. This primary seal is often necessary to provide a relatively long-shelf life, (i.e., six months to two years) for the sheets 12 in the pocket portion 14. In the embodiment shown in FIGS. 1 and 2, the primary seal is provided by a pliable, moisture-impervious protective sheet 26 that is disposed over the dispensing opening 22, and is releasably secured to the second wall 20. In another embodiment, the primary seal is provided by releasably sealing flap 16 to second wall 22 around the dispensing opening 22. In this configuration, flap 16 functions as a protective sheet. Other means for providing a primary seal for the pocket portion 14 may also be used. For example, the second wall 20 initially may not have the dispensing opening 22 extending through it. Instead, the second wall 20 may be partially weakened in the configuration of a desired opening, and the dispensing opening 22 formed by removing the section of the second wall 20 which is circumscribed by the partially weakened region. Second wall 20 can be partially weakened by scoring, by perforating, or by heat sealing the flap 16 to the second wall when both are made of plastic or other suitable materials. For example, when second wall 20 is scored, a user simultaneously breaks the primary seal of pocket portion 14 and forms the dispensing opening 22 by removing the section of second wall 20 which is circumscribed by the scored region. When second wall 20 is partially weakened by perforations, protective sheet material, such as plastic film, can be placed over the perforations, or flap portion 16 can be releasably sealed to second wall 20 to prevent the escapage of moisture through them. In this specification and in the claims, the phrase "dispensing opening including a primary seal" defines not only a dispensing opening extending through a wall of the pocket portion 14 and including a separate primary seal, but also defines a dispensing opening that is formed by removing a section of a wall of the pocket portion 14. The removable section of the wall functions as though it were a primary seal over the dispensing opening.

Preferably the flap 16 is a unitary extension of one wall of the pocket portion 14. In the embodiment shown, the flap 16 is a unitary extension of the first wall 18, and is adapted to be removably secured over the dispensing opening 22 to provide a secondary seal after the primary seal has been broken. Preferably, the flap 16 is removably secured over the dispensing opening 22 by folding the flap over the dispensing opening and pressing the flap into contact with a pressure-sensitive adhesive 28 that is disposed on the second wall 20. Alternatively, the pressure-sensitive adhesive 28 can be disposed upon the flap 16. In some embodiments, it may be preferred to include a crease line 30 (a region of reduced thickness) across the width of the flap 16 and adjacent to the border the flap forms with the pocket portion 14, to facilitate retaining the flap over the dispensing opening 22.

The pocket portion 14 and flap portion 16 are made of a thin, pliable and compactable material that is moisture-impervious, foldable, waddable or otherwise manipulatable into various shapes and configurations. For example, thin sheets of polyester or polyolefin plastic are quite suitable for use in this invention. These sheets are preferably employed in the thickness range of about 0.001 to 0.012 mils. In the preferred embodiment, the plastic sheets have a thickness range of 0.003 mils. The protective sheet 26, which in the preferred embodiment is employed to provide a primary seal over the dispensing opening 22, can also be made of thin plastic or other flexible, compactable materials such as metallic foils, coated papers, and laminates of plastic, foil and/or paper.

Figure 3:
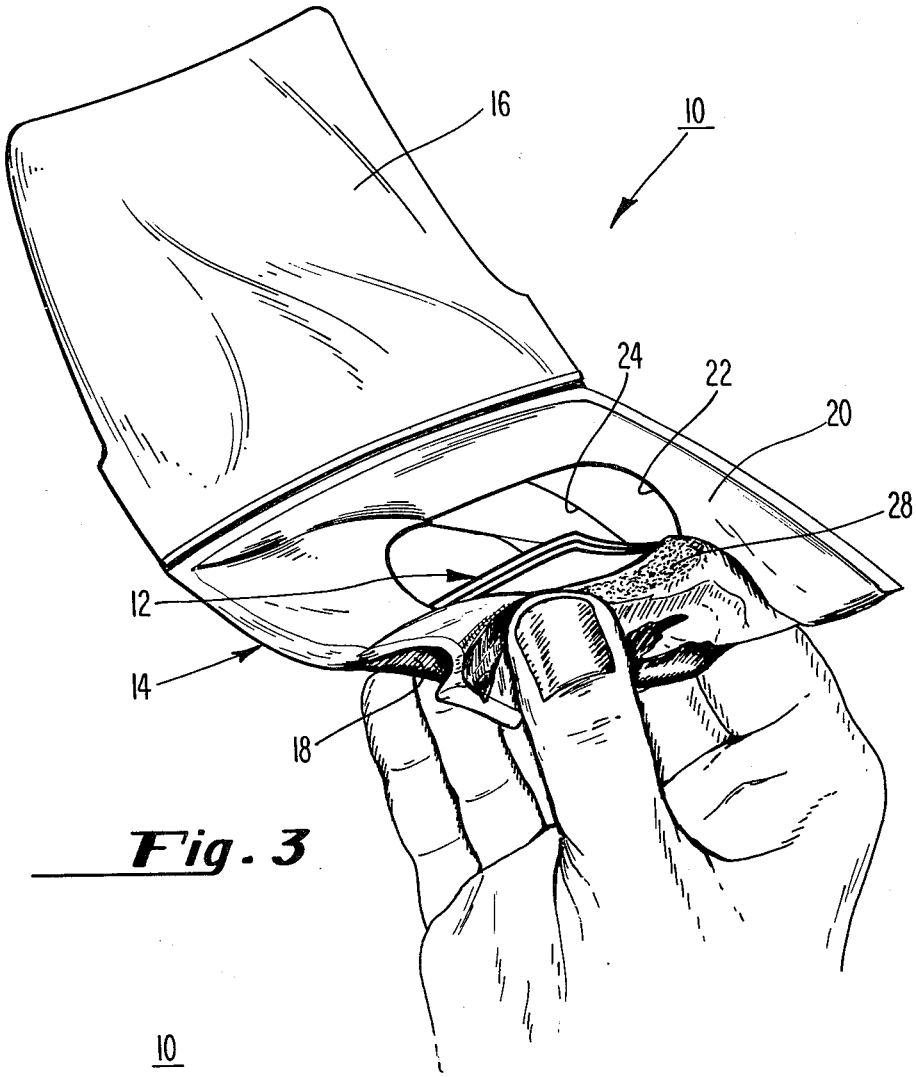
FIG. 3 is a perspective view illustrating the dispensing of a group of premoistened sheets from the package.

To use the package 10 of this invention, a user simply lifts flap 16, and breaks the primary seal to expose the dispensing opening 22 and the stack of sheets 12 thereunder. Then, the user grasps the dispensing edge 24 of the uppermost sheet and pulls the sheet out of the pocket portion 14. This leaves the next sheet ready for dispensing in the same manner. When the premoistened sheets in the stack are not folded, the package 10 can be easily bunched, wadded or manipulated so that a marginal edge of a single sheet can be grasped and the sheet pulled from the pocket portion 14. A group of premoistened sheets, whether folded or unfolded, can be dispensed from the package 10 by pressing an edge of the stack of sheets towards the dispensing opening 22 until the marginal edges of as many sheets as desired are exposed in the opening (FIG. 3). The desired group of sheets can then be gripped by their marginal edges and pulled through the dispensing opening 22. Thereafter, the package 10 can be reclosed and sealed by closing the flap portion 16 over the dispensing opening 22 and pressing it into contact with the pressure-sensitive adhesive 28.

Figure 4B:
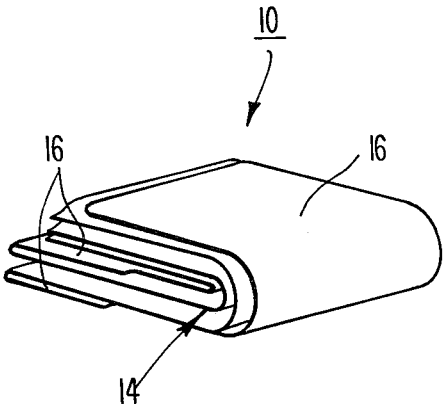
FIGS. 4*a* and 4*b* are isometric views of the package in two different compacted states.
Figure 4A:
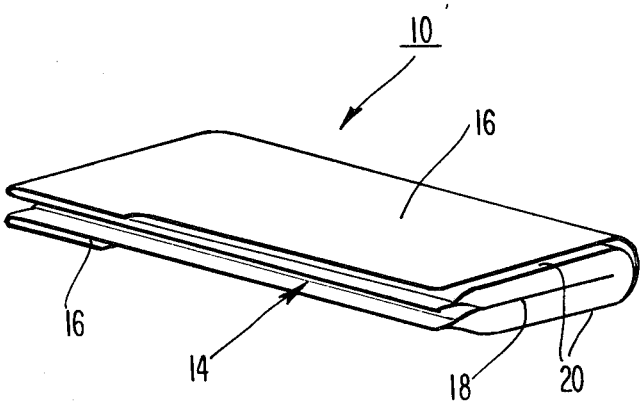

Because the package 10 is made of pliable, compactable material, it can be wadded, folded, or otherwise manipulated into compact configurations to fit into a pocket, a purse, a bag, or other place where space is at a premium. FIGS. 4*a* and 4*b* show two different arrangements into which the package 10 can be folded; however, these specific folded arrangements are not limiting on the present invention. Because flap portion 16 and pocket portion 14 are pliable and removably secured together by pressure-sensitive adhesive 28, the flap is maintained over and continues to provide a secondary seal for the dispensing opening 22 despite the shape or configuration that package 10 is manipulated into. After the primary seal has been broken, this secondary seal prevents both the premature evaporation of the moisturizing ingredients from the sheets, and the undesirable leakage of such ingredients from the package.

Having described my invention, I claim:

1. A disposable, pliable and compactable moisture-impervious package for dispensing a stack of premoistened sheets, said package comprising:

a. a pocket portion of pliable and compactable moisture-impervious material, said pocket portion including first and second walls adhered to each other to provide a compartment between them for receiving the stack of premoistened sheets;

b. the stack of premoistened sheets disposed within the compartment with flat surfaces of the sheets generally parallel to the first and second walls of the pocket portion;

c. a dispensing opening in one wall of the pocket portion and overlying the flat surfaces of the premoistened sheets, said dispensing opening having a long dimension extending transversely across said one wall and a short dimension substantially perpendicular to said long dimension, sheets of the stack being folded to provide a dispensing edge disposed generally perpendicular to the long dimension of said opening and intersecting said opening, the dispensing opening including a primary seal for preventing undesirable evaporation of moisture from the sheet;

d. a flap portion of pliable and compactable moisture-impervious material joined to the pocket portion through a hinge line that is generally parallel to the long dimension of the dispensing opening, said flap portion extending beyond the pocket portion and being foldable at the hinge line to overlie the dispensing opening; and e. securing means for removably securing the flap portion to the pocket portion when the flap portion overlies the dispensing opening to provide a secondary moisture-impervious seal after the primary seal has been broken and between the dispensing of sheets, said securing means maintaining the secured connection between the flap portion and the pocket portion when said package is in a compacted or uncompacted state.

2. The package of claim 1, wherein the flap portion is a unitary extension of a wall of the pocket portion.

3. The package of claim 1, wherein the primary seal is a sheet of pliable and compactable moisture-impervious material removably secured over the dispensing opening.

4. The package of claim 1, wherein the pocket portion and flap portion are made of a pliable and compactable plastic material.

5. The package of claim 1, wherein the securing means for removably attaching the flap portion to the pocket portion includes a pressure-sensitive adhesive.

6. The package of claim 5 wherein the flap is heat sealed to the wall in which the dispensing opening is formed to provide the primary seal and form the dispensing opening.

7. A pliable and compactable moisture-impervious package for dispensing a stack of prefolded, premoistened sheets, said package comprising:

a. a pocket portion of pliable, compactable plastic material having substantially flat first and second walls adhered together to provide a compartment for receiving the stack of prefolded, premoistened sheets, the second wall having a dispensing opening extending therethrough and overlying the flat dimension of the stack of sheets, said dispensing opening having a long dimension extending transversely across the second wall and a short dimension extending generally perpendicular to the long dimension, each sheet in the stack of sheets having a dispensing edge disposed generally perpendicular to the long dimension of the dispensing opening and intercepting said opening;

b. a protective sheet sealingly secured over the dispensing opening to form a primary seal; and c. a substantially flat, pliable and compactable flap portion extending from the first wall of the pocket portion and being joined to said first wall through a hinge line that is generally parallel to the long dimension of the dispensing opening, said flap portion being removably securable over the dispensing opening by a pressure-sensitive adhesive disposed between the flap portion and the second wall so that the flap portion provides a secondary moisture-impervious seal for the package after the primary seal has been broken and between the dispensing of sheets, said secondary seal being provided when said package is in a compacted or uncompacted state.

* * * * *